United States Patent [19]

New

[11] Patent Number: 4,695,196

[45] Date of Patent: Sep. 22, 1987

[54] PAD-TYPE INFLATABLE SEAL FOR A REMOVABLE BOTTOM FOUNDED STRUCTURE

[75] Inventor: Richard New, Kenmore, N.Y.

[73] Assignee: Chevron Research Company, San Francisco, Calif.

[21] Appl. No.: 835,419

[22] Filed: Mar. 3, 1986

[51] Int. Cl.[4] ..... E02B 17/00; E02D 5/74

[52] U.S. Cl. ..... 405/224; 405/195; 405/203

[58] Field of Search ..... 405/203, 204, 205, 195; 114/296; 277/34, 34.3, 34.6, 226; 49/477

[56] References Cited

U.S. PATENT DOCUMENTS

| | | | |
|---|---|---|---|
| 2,530,160 | 11/1950 | Finley | 49/477 |
| 2,657,661 | 11/1953 | Robson | 49/477 X |
| 2,686,343 | 1/1951 | Harpoothian et al. . | |
| 2,720,011 | 10/1955 | Krupp | 49/477 |
| 2,937,006 | 5/1960 | Thayer | 255/2.5 |
| 3,348,517 | 10/1967 | Johnson, Jr. et al. | 114/206 |
| 3,494,136 | 2/1970 | Wilms . | |
| 3,520,543 | 7/1970 | Etter et al. | 277/205 |
| 3,701,500 | 10/1972 | Zeffer et al. | 49/477 X |
| 3,892,287 | 7/1975 | Bennett | 180/115 |
| 3,896,628 | 7/1975 | Hansen . | |
| 3,961,490 | 6/1976 | Corgnet . | |
| 4,155,671 | 5/1979 | Vos | 405/203 |
| 4,425,055 | 1/1984 | Tiedemann | 405/217 |
| 4,521,133 | 6/1985 | Suzuki et al. | 405/195 |
| 4,522,532 | 6/1985 | Fedrick | 405/195 X |
| 4,576,518 | 3/1986 | Cooke et al. | 405/195 X |

FOREIGN PATENT DOCUMENTS 2247377 6/1975 France .

OTHER PUBLICATIONS

A. Della Greca, "New Concept of Offshore Drilling/-Production Arctic Platform and Dynamic Analysis . . . ", 2/12-17/84, ASME, 1984.

Buslov et al, "Detachable Systems—Alternative Approach for Arctic Exploratory Structures", pp. 519-529.

Stenning et al, "Arctic Offshore Deepwater Ice Structure Interactions", OTC 3630, pp. 2356-2365.

G. Sebastiani et al, "Offshore Drilling and Production Platforms with Rapid Removal and Redeployment . . . ", pp. 631-642.

*Primary Examiner*—Dennis L. Taylor

*Attorney, Agent, or Firm*—E. J. Keeling; P. L. McGarrigle; V. A. Norviel

[57] ABSTRACT

The Removable Bottom Founded Structure (RBFS) is an offshore platform for petroleum drilling and producing operations intended for deployment in waters with severe weather and iceberg conditions. The structure is normally held down by gravity, but during the deballasting procedure a hold-down system is employed to keep the platform on the subbase until site evacuation. The system that is used to hold the platform down onto the subbase is located where the platform meets the subbase. It operates on the principle of hydrostatics. On the underside of the columns there are multiple chambers which may be evacuated by pumping and which are vented to the outside atmosphere. Inflatable seals that define these chambers are positively engaged by this evacuation to create a fluid-tight seal so that no seawater will enter the evacuated chambers. The reduction of the buoyancy forces will hold the platform onto the subbase until such time as the platform is totally deballasted. Once that has occurred, the hydrostatic hold-down system is disengaged and the platform will quickly rise to the surface.

The structure is normally held down by gravity, but during the deballasting procedure a hold-down system is employed to keep the platform on the subbase until site evacuation. The system that is used to hold the structure down onto the base is located in the underside of the column and operates on the principle of hydrostatics. There are multiple chambers which may be evacuated by pumping and then vented to the outside atmosphere. Flexible seals within these chambers are positively engaged by water at a pressure that is greater than the atmospheric pressure within the evacuated chambers. This will hold the platform onto the subbase until such time as the platform is totally deballasted. Once that has occurred, the hydrostatic hold-down system is disengaged and the platform quickly rises to the surface.

1 Claim, 4 Drawing Figures

$P_1 = \delta \cdot h_1 \cdot A$

SIMULATED NORMAL OPERATION
HOLDDOWN SYSTEM NOT ACTIVATED $P_2 = \delta \cdot h_2 \cdot A$

SIMULATED LIFT-OFF PROCEDURE
HOLDDOWN SYSTEM ACTIVATED $\delta$ = DENSITY OF $H_2O$
$h_1, h_2$ = HEIGHT OF $H_2O$ IN A TUBE
A = AREA OF BOTTOM OF COLUMN

PAD-TYPE INFLATABLE SEAL FOR A REMOVABLE BOTTOM FOUNDED STRUCTURE

This application is related to applications having the problem Ser. Nos. 835,420; 866,825; 839,492; 839,525; 869,524; and 898,989, all assigned to the assignee of this application

FIELD OF THE INVENTION

This invention generally relates to offshore oil drilling and producing structures. More specifically, to a sealing/hold-down system that is used on a structure for removably detaching that structure from a base located on the sea floor.

BACKGROUND OF THE INVENTION

As oil exploration continues in remote locations, the use of offshore drilling techniques and structures will become more commonplace in ice-infested areas. Platforms are continually erected in isolated areas that have extremely severe weather conditions. However, the structures that operate in more temperate climates cannot usually be employed here because they must be able to cope, not only with severe arctic storms and sea ice incursions, but also with large and small icebergs that are driven by wind, current and wave action. Because of these condition, many different types of platform designs have arisen in an attempt to cope with the harsh weather and other natural elements.

Currently, much exploration is conducted in the arctic and in the ice-infested waters off Alaska, Canada, and Greenland. To cope with the iceberg and weather problem, some structures attempt to resist these large ice masses by simply being large enough to withstand the crushing forces. Examples of these designs may be seen in dual cone structures, such as U.S. Pat. No. 4,245,929, large reef-like structures, or many other gravity based large concrete-steel configurations, see also U.S. Pat. No. 4,504,172. However, these structures are either too heavy, expensive, or are permanently affixed to the bottom. As such, they do not lend themselves to either reuse or quick site evacuation in the case of an emergency situation.

Another design is a tension-leg platform (TLP) with disengageable or extensible legs as described in U.S. Pat. Nos. 3,955,521 and 4,423,985. These too have their inadequacies. The TLP floats by its own buoyancy, which means that it cannot take a substantial deck load. Furthermore, there may be problems with icebergs that have drafts large enough to scour the sea floor. Most TLP structures have exposed wellheads and anchoring systems and thus would incur substantial damage if an iceberg of this size came along. Additionally, since the platform is naturally buoyant, the tendons are under constant tension which generally shortens the life of the tie down system.

Another factor to be considered is cost. Generally, the type of large gravity-based structure that may be used for arctic exploration and production is very expensive and time consuming to build. With the unproven nature of some of the oil prospects, the harshness of the environment, the increased costs due to the weather down time, the probability of failure, and even the political climate, it becomes even more risky for an oil company to invest a large amount of money or time. In the event of an accident or other type of misadventure, losses could be greatly mulitplied.

To overcome many of the disadvantages of these previously discussed arctic structures, it would be advantageous to combine some of the principles of the gravity-based structures with those of the floating structures. This is accomplished by constructing a platform that has subsurface hull chambers that may alternatively provide buoyancy or ballast and a subbase upon which the platform may rest. This structure may be floated to a drilling or production site and slowly filled with ballast until it rests on the sea floor. When a situation, threatening to the structure, presents itself, the platform may be deballasted and removed from the site to leave the subbase behind. However, this deballasting procedure is quite slow (on the order of 6 to 7 hours) and since it is probably going to be done in rough seas, there is a large chance that the structure may be damaged when it "bounces around" as it approaches neutral buoyancy, but before it reaches its floating draft.

A solution to this problem is to keep the platform down on the subbase with a hold-down means while it is being deballasted. Once it has fully deballasted, the hold-down means may then be released to allow the platform to quickly ascend to its floating draft and escape damage.

This hold-down system may be mechanical or hydraulic. However, because a mechanical system: may not assure a simultaneous release of all mechanical systems; is expensive; and difficult to reuse, a hydrostatic sealing system is chosen. This hydrostatic system will hold the structure to the base from the beginning of the deballasting procedure to the time when deballasting is complete. When this occurs, the structure may be quickly detached by releasing the seal and then floated away from the impending danger.

To eliminate most of the problems of these previously-mentioned arctic structures for use in ice-infested waters, the Removable Bottom Founded Structure (RBFS) was developed to provide a platform which may be removably detached from its base with the help of the aforementioned seals and, if necessary, transported to a safer location.

SUMMARY OF THE INVENTION

The present invention holds a buoyant platform onto a subbase that rests on the sea floor. The platform is called a Removable Bottom Founded Structure (RBFS) and it is designed for the arctic environment. The RBFS resembles a very large submersible drilling platform which, by virtue of its direct access to the wells, functions in many ways like a conventional fixed drilling and production platform. Normally, the platform would be fully ballasted on the subbase with a combination of water and solid ballast. However, in the event of an approaching iceberg larger than one which the RBFS is designed to resist the sealing system is engaged, the platform is deballasted to a positive buoyancy condition, the risers are disconnected from the subbase, the sealing system is released, and the platform floats, and propels itself off location to leave the subbase behind. The platform must disconnect from the subbase and reach its floating draft very quickly to avoid potential collision between the platform and subbase. Here, the hold-down system keeps the platform down on the subbase, and when the columns and pontoons are deballasted to achieve a large net buoyant upward force, the hold-down mechanism is quickly released to lift off the platform.

To assist in providing an appropriate hold-down mechanism, an inflatable seal is affixed to the underside of the platform to establish a fluid-tight seal between the outside seawater and the area between the platform and the subbase. Once the barrier is established, the hydrostatic head in the area underneath the platform may be reduced to keep the platform on location. The platform stays in place during this time by effectively removing the buoyancy forces from the underside of the columns; thus, the platform alone holds itself down as if it were not resting on water. It will remain there until such time when it is fully deballasted.

DETAILED DESCRIPTION OF THE INVENTION

The Removable Bottom Founded Structure (RBFS) is an offshore structure for petroleum drilling and producing operations and is intended for deployment in waters with severe weather and iceberg conditions. The RBFS is a two-part structure. The first part generally comprises a platform and is made up of multiple columns which are affixed to a deck structure. The second component is a reinforced concrete subbase that rests on the sea floor and upon which platform is founded.

The RBFS is designed to withstand severe conditions of wind, wave and current action, and many of those ice conditions which could normally be expected during the structure's life. For example, the RBFS was designed to withstand a 150-year return period storm; an iceberg with a 20-year return period kinetic energy; and to survive (with some damage) upon impact with an iceberg having a 100-year return period kinetic energy. However, if an iceberg large enough to cause damage to the RBFS threatens to come in contact with the structure, the platform is evacuated from the site to leave the subbase behind. To ensure that the inhabitants and operators of the RBFS are apprized of all iceberg and storm dangers, they maintain visual lookouts for good days and shorter distances, whereas they use a radar system could be used for longer distances and less clear weather. Danger zones, having specified radii, may also be established to allow the platform personnel to gauge the possibility of actual iceberg incursion.

Figure 1:
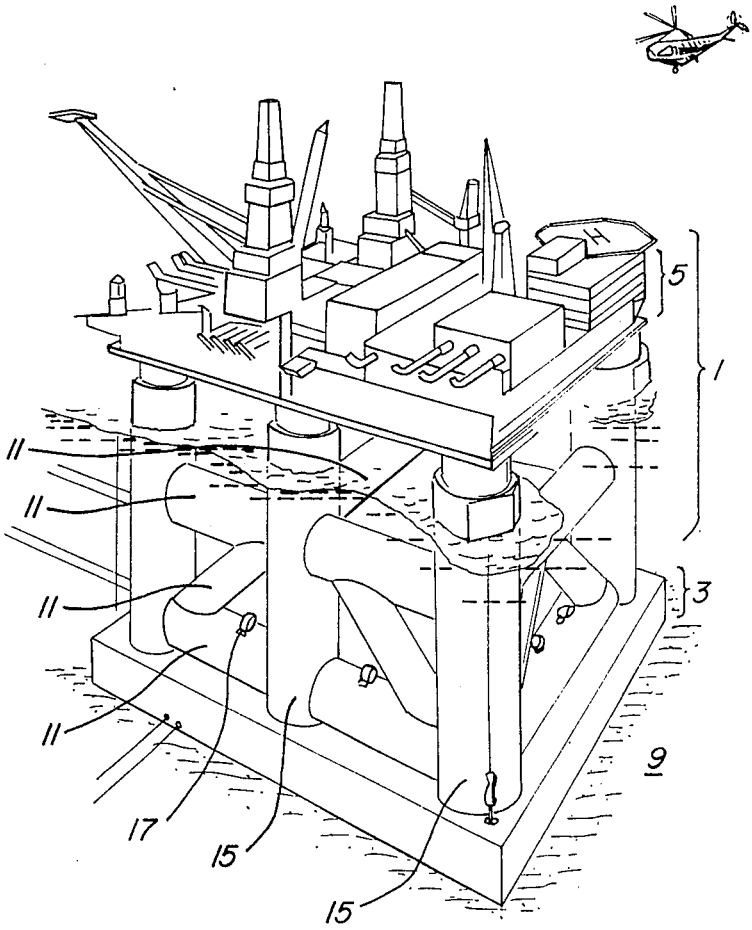
FIG. 1 is a view of the assembled platform resting on the subbase.

FIG. 1 above that the RBFS comprises two portions, a platform 1 and a subbase 3. The platform 1 is comprised of a deck 5 and columns 15. The subbase 3 is affixed to the sea floor 9 and provides a surface to receive axial and lateral loads from the platform 1.

The subbase 3 is a permanent reinforced concrete structure, the configuration of which is shown in FIG. 1. It is designed to withstand a 100-year iceberg impact with practically no movement and no structural damage and is able to survive a 2000-year iceberg, (while it protects a subsea well template), with limited damage. The subbase 3 provides a bearing surface for vertical and lateral load transfer from the platform 1 and protects the well template from iceberg scour.

To prevent potential collision between the platform 1 and the subbase 3 during an iceberg avoidance operation, the platform 1 must rise quickly to its floating draft, otherwise there is a risk the platform 1 may come in contact with the subbase 3. Furthermore, to shorten the overall iceberg avoidance procedure, the platform 1 must be deballasted concurrently with other iceberg avoidance operations such as shutting in wells and purging and disconnecting the risers. To enable the platform 1 to be held onto the subbase 3 while it is deballasted (and becoming more bouyant) the hydrostatic pressure acting on the platform 1 must be reduced. To accomplish this, a system of seals enclose the perimeter of the base of each corner column 15. After the space between the subbase 3, the column 15, and the seals is shut off from the outside seawater, the hold-down system is activated. This reduces the hydrostatic pressure acting on the bottom of the column 15 and will effectively hold the platform 1 on the subbase 3.

Figure 4:
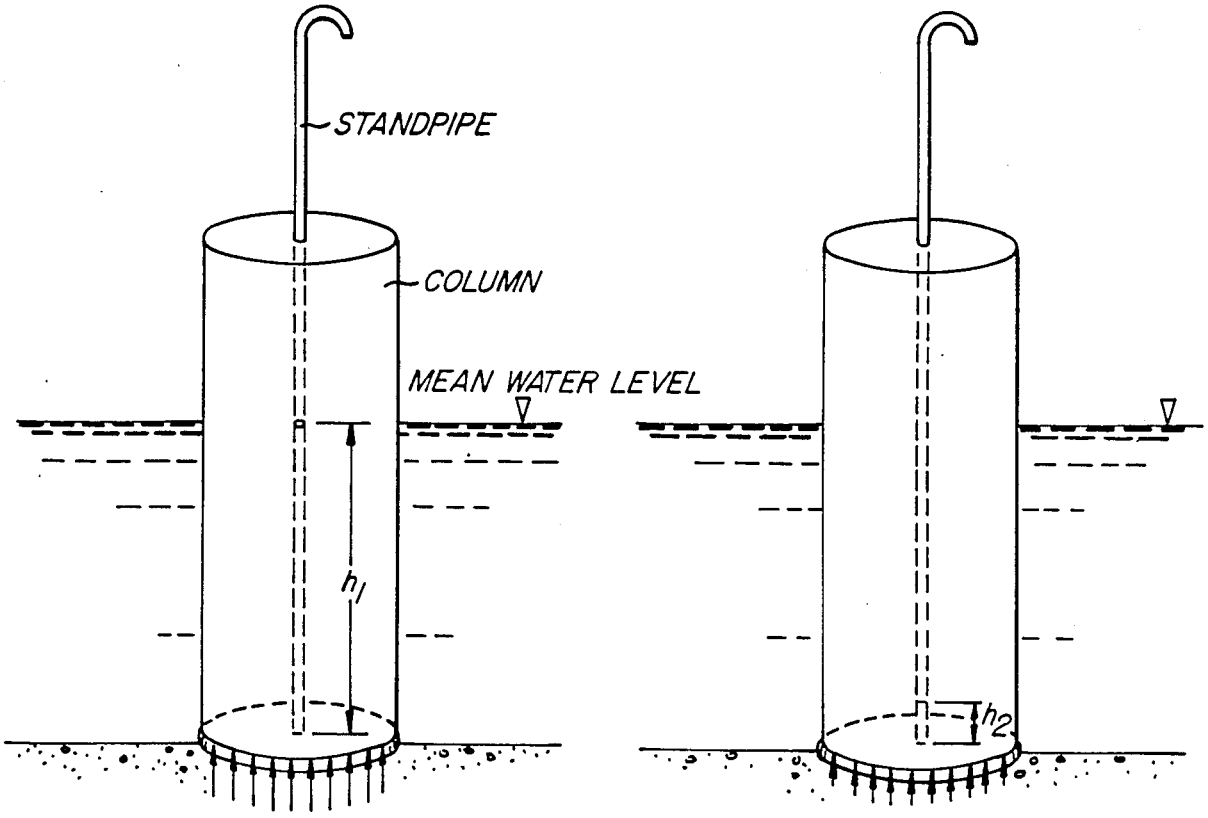
FIG. 4 represents the forces that act on the underside of a buoyant column.

The hydrostatic hold-down system reduces the hydrostatic head on the area underneath the column 15. This is shown in FIG. 4 which represents the buoyancy forces that act on a column 15 before and after the sealing system is engaged. In normal states, the buoyant force acting on a column 15 may be shown by $P_1=\delta.h_1.A$ where $P_1$ is the total buoyant force, $\delta$ is the density of water, $h_1$ is the height of water in the standpipe, and A is the area underneath the column 15. However, operation of the hold-down system reduces the water level in the standpipe to $H_2$. This decreases the buoyant force to a new value which can be expressed as $P_2=\delta.h_2.A$. As a result, the hold-down system maintains a difference in hydrostatic pressure between the outside environment and the area underneath the column 15 as long as it is engaged.

Figure 2:
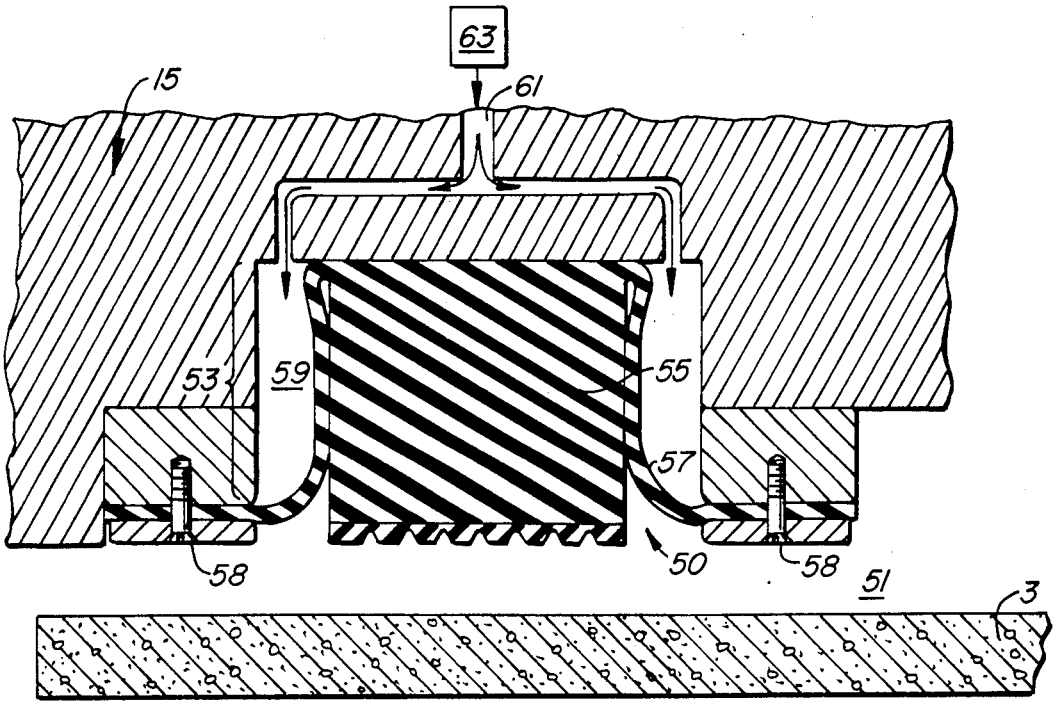
FIG. 2 is an enlarged view of a single sealing system.
Figure 3:
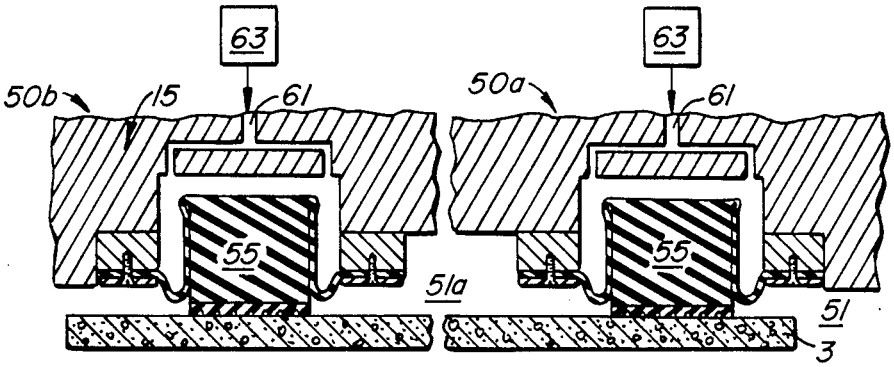
FIG. 3 is a cross-sectional view of the hold-down sealing system as deployed.

FIGS. 2 and 3 show the seal 50 (which is a reinforced elastomeric bearing pad), set in a recessed chamber 53 in the column 15. The seal 50 has a thin flexible portion 57 and a thick portion 55 that engages the subbase. The thin portion 57 seals the recessed chamber 53 off from the outside environment. It is fastened to the column 15 by bolts 58 to form an enclosed chamber 59 which is fluid-tight. A manifold 61 communicates between the enclosed chamber 59 and a pressurizing means 63 (to force the thick portion 55 outward against the subbase 3). Two of these seals 50 would be concentrically arranged to provide a redundant system.

This seal 50 functions on two levels; the mechanical compression of the thick portion 55 and hydraulic loading of the thin portion 57. This allows for 10% deflection assuming proper mating of the column 15 and the subbase 3. (FIG. 3 shows a space between the column 15 and the subbase 3, but the space does not have to be as large as depicted). When the head is reduced in the chamber 51 behind the seal 50, bearing pressure should seal off the chamber 51 from any leakage across the seal 50. However, if the sealing gap is too great (between the subbase 3 and the thick portion of the seal 55) then the hydraulic pressure in enclosed chamber 59 would be increased by means 63 to force the thick portion 55 against the subbase 3 for proper sealing. Means 63 may be hydraulic pressure induced by gravity or pump.

During normal platform operation, when the RBFS behaves as a gravity structure and a hold-down force is not needed, the chamber 51 is open to the ambient hydrostatic pressure. As the platform 1 is deballasted and becomes more buoyant, the hydrostatic pressure in the chamber 51 is reduced to create a hold-down force. The hold-down force would equal the product of the plan area of the chamber 51 and the differential pressure in the chamber 51 which is $\Delta P = \delta(h_1 - h_2)$ (the differential pressure is the ambient hydrostatic pressure at the top of the subbase 3 less the pressure in the chamber 51 which corresponds to the water level in the chamber 51). The sum of the hold-down forces at each corner column 15 would be sufficient to prevent uplifting of the platform 1 under the combined effects of the buoyancy of the deballasted platform 1 and the design storm loads. The hold-down force could be deactivated by opening the chamber 51 to the ambient hydrostatic pressure.

Operation of the hydrostatic hold-down system is not necessary for the RBFS during normal operating conditions (because it is normally held in place by gravity), however, the seals 50 would be frequently tested for leaks. Prior to evacuation the seals 50 would be engaged, and the platform 1 would be deballasted by pumping out the ballast chambers. The pumps are sized such that the entire platform 1 can be deballasted in five hours. Redundant control of ballast tanks from several independent pumps is designed into the system, and ballast control is fully automated with manual backup.

If the seals 50 are effective, then essentially all the water in the space 51 is removed. A float valve (not shown) may be used to turn off an evacuation pump when the water is gone and may reactivate the evacuation pump in the event of water leakage into the space 51. While the platform 1 is fully deballasted and the area defined by the seals 50 has been evacuated, the various mechanical systems are prepared for liftoff.

Since the RBFS is intended to evacuated the site on impending impact of a large iceberg, all piping and control lines between the platform 1 and subbase 3 are readily disconnectable. (None of the following material is illustrated.) Therefore, the next step before site evacuation is to hydraulically disengage the riser mechanical latching system to lift the entire integrated riser bundle into the column 15 by means of hydraulic hoists. The production and injection wells and oil sales lines are shut in subsea and all lines in the integrated riser are purged with seawater. This is the final preparatory step in the liftoff procedure.

The platform 1 may be lifted off the subbase 3 by destroying the difference in the hydrostatic pressure between the space 51 and the outside seawater. To equilibrate the pressure in the space 51 (to that of the seawater) additional pressure may be used from such things as pumps, etc., but an easier way to destroy the pressure differential would be to allow water at that depth to flow into the space 51 from the outside. Once that is done the pressure on both sides of the thick portion 55 of the seal 50 will be equal and the natural buoyancy of the platform 1 will cause the platform 1 to rise. Immediately after the platform 1 lifts off the subbase 3, the platform 1 moves away under positive navigational control achieved with a thruster system built into the platform 1. Thrusters 17 (See FIG. 1) are positioned at locations on the platform 1. The thruster system is designed to steer the platform 1 in a controlled manner, but not to stationkeep in severe storm states. Tugs in the vicinity (for iceberg towing, surveillance and other purposes) provide further steering control once sea conditions permit attachment of towing lines.

When sea and ice conditions again permit, the platform 1 is resited on subbase 3 and platform 1 is reballasted. The integrated riser bundle (this system is not shown) is stabbed into its receptacle in subbase 3, hydraulic hoists are used to stab a riser connector down onto a connector mandrel, and integrated riser is reconnected to the wellhead. Drilling risers (also not shown) are also reattaching to well template through a moonpool and the normal operations are again resumed.

Since many modifications and variations of the present invention are possible within the spirit of this disclosure, it is intended that the embodiments disclosed are only illustrative and not restrictive. For that reason, reference is made to the following claims rather than to the specific description to indicate the scope of this invention.

What is claimed is:

1. A sealing apparatus for affixing a gravity founded, movable offshore structure onto a sub-base that rests on the sea floor, during the time when the movable structure is being deballasted in preparation for rapid site removal, comprising:

a movable offshore platform;

at least one load bearing member for supporting the platform, the member being fixedly connected to the platform and extending in a generally downward direction from the platform, the underside of the member having a generally flat surface;

a subbase also for providing support to the platform, the subbase having a generally flat surface so that the member may rest on the upper surface of the subbase;

a recessed chamber within the member;

a flexible elastomeric seal attached to both sides of the recessed chamber to seal the recessed chamber off from the outside sea environment and make it fluid-tight;

a pad attached to the outside of the elastormeric seal, the pad arranged to undergo mechanical compression when properly mating the subbase;

a manifold line connected to the fluid-tight recessed chamber;

means for creating an internal pressure within the recessed chamber through the manifold line;

means for creating a space between the member and the subbase; and means for evacuating the space between the member and the subbase to reduce the hydrostatic pressure within the space to a point lower than the surrounding seawater;

so that when the recessed chamber is pressurized the flexible seal will create a fluid-tight seal against the sub-base so that the hydrostatic pressure in the space may be reduced to keep the platform on the subbase until such time as the pressure in the space is equalized with the surrounding seawater.

* * * * *